US009654860B2

(12) United States Patent
Shin

(10) Patent No.: US 9,654,860 B2
(45) Date of Patent: May 16, 2017

(54) SOUNDPROOF HOUSING FOR EARSET AND WIRED AND WIRELESS EARSET COMPRISING SAME

(71) Applicant: HAEBORA, Seoul (KR)
(72) Inventor: Doo Sik Shin, Seoul (KR)
(73) Assignee: HAEBORA, Seoul (KR)

( * ) Notice: Subject to any disclaimer, the term of this patent is extended or adjusted under 35 U.S.C. 154(b) by 140 days.
(21) Appl. No.: 14/388,386
(22) PCT Filed: Nov. 9, 2012
(86) PCT No.: PCT/KR2012/009490
§ 371 (c)(1),
(2) Date: Sep. 26, 2014
(87) PCT Pub. No.: WO2013/147385
PCT Pub. Date: Oct. 3, 2013
(65) Prior Publication Data
US 2015/0055810 A1 Feb. 26, 2015
(30) Foreign Application Priority Data
Mar. 29, 2012 (KR) ..... 10-2012-0032199
(51) Int. Cl.
*H04R 25/00* (2006.01)
*H04R 1/10* (2006.01)
*H04R 1/02* (2006.01)
(52) U.S. Cl.
CPC ..... *H04R 1/1083* (2013.01); *H04R 1/02* (2013.01); *H04R 1/1016* (2013.01);
(Continued)
(58) Field of Classification Search
CPC ..... H04R 1/1083; H04R 1/02; H04R 1/1016; H04R 1/105; H04R 1/1075; H04R 1/1091;
(Continued)

(56) References Cited

U.S. PATENT DOCUMENTS

2008/0226090 A1* 9/2008 Seto ..... H04R 3/02 381/66
2009/0290733 A1* 11/2009 Klemenz ..... H04R 25/65 381/312

FOREIGN PATENT DOCUMENTS

JP 2009516409 A 4/2009
KR 200296816 Y1 12/2002
(Continued)

OTHER PUBLICATIONS

International Search Report for application No. PCT/KR2012/009490 dated Feb. 25, 2013.

*Primary Examiner* — Leshui Zhang
(74) *Attorney, Agent, or Firm* — Hauptman Ham, LLP

(57) ABSTRACT

The present invention provides a soundproof housing for an earset, comprising: a housing main body, coupled to the inside of a front surface case having a protrusion portion inserted into the ear, and provided with a speaker accommodation groove and a microphone accommodation groove; a speaker output hole, penetratingly formed in the speaker accommodation groove so as to communicate with the front surface case, and adjacent to the output end of the speaker; and a microphone input hole, formed in a recessed manner inside the microphone accommodation groove so as to communicate with the front surface case, and adjacent to the input end of the microphone, wherein the housing main body is protrudingly formed as a long protrusion toward the inside of the protrusion portion of the front surface case, so as to be tightly coupled with the inside of the protrusion portion of the front surface case.

15 Claims, 12 Drawing Sheets

(52) U.S. Cl.
CPC ..... *H04R 1/1075* (2013.01); *H04R 25/65* (2013.01); *H04R 2410/03* (2013.01); *H04R 2420/07* (2013.01)

(58) Field of Classification Search
CPC ... H04R 1/18; H04R 1/32; H04R 1/44; H04R 25/00; H04R 25/65; H04R 25/652; H04R 25/654; H04R 25/656; H04R 25/658; H04R 2410/03; H04R 2410/05; H04R 2420/07; H04R 2499/11; H04R 3/02; H04R 1/10; H04R 5/033; H04M 1/6041; H04M 1/6058; H04M 1/6066; H04M 1/05; H04M 2250/02
USPC ..... 381/74, 73.1, 309, 61, 111, 312, 322, 381/324, 351, 345, 367, 374, 380, 382, 381/395, 124; 181/189, 190; 455/575.2, 455/575.1, 569.1
See application file for complete search history.

(56) References Cited

FOREIGN PATENT DOCUMENTS

| | | | | |
|---|---|---|---|---|
| KR | 1020060129062 | A | | 12/2006 |
| KR | 101023467 | B1 | * | 3/2011 |
| KR | 101082372 | B1 | | 11/2011 |

* cited by examiner

*-Prior Art-*

SOUNDPROOF HOUSING FOR EARSET AND WIRED AND WIRELESS EARSET COMPRISING SAME

TECHNICAL FIELD

The present disclosure relates in some embodiments to a wired and wireless earset formed as an in-the-ear type with an integrated microphone and speaker, and more particularly, a soundproof housing for an earset installed within an earset for the soundproof of external noise with waterproof function, and a wired and wireless earset comprising the same.

BACKGROUND ART

In general, an earset is a device for voice reception and transmission combining an earphone (speaker) and a microphone (mic), which is wire or wireless connected to electronic devices such as an MP3 player and a mobile phone so that sound or voice is received or transmitted via a user's ear or a mouth.

An earset with a usual form separately has a speaker that outputs sound is inserted into a user's ear and a microphone that is arranged in the vicinity of a user's mouth; in other words, a speaker and a microphone are arranged apart. An earset having the usual form above is widely used due to its convenience that a user freely use his or her both hands even if the earset is in the bag or pocket, enabling the user to listen to music or make a call even in such situation.

However, an earset with a usual form cannot clearly deliver sound to its user in cases such as a noisy environment or situations where a user moves his or her body so that an earphone in the ear is removed or the microphone is shaken.

To resolve those issues, an integrated earset to deliver sound clearly in a noisy surrounding due to its form where both a speaker and a microphone are inserted into the ear has been disclosed.

FIG. 1 is a schematic composition of an integrated earset in accordance with an existing embodiment.

As shown in FIG. 1, an integrated earset 1 comprises a speaker 3 and a microphone 4 within a case 2 inserted into a user's ear. A connector 5 connected to an end of a cable 6 is coupled with an electronic device 7, and a speaker 3 and a microphone 4 are electrically connected with a cable 6. Thus, a speaker 3 outputs sound to a user's external auditory canal, and the sound generated from a user's mouth is transformed into a postelectrical signals being delivered into a microphone 4 via an external auditory canal and is delivered to an electrical device 7.

However, the integrated earset 1 also has an echoing or howling effect due to inflow of external noise into the inside of a case 2, or an interference by a speaker 3 or a microphone 4 or an oscillation within the case 2 occurs, thus reducing the sound quality.

DETAILED DESCRIPTION

Technical Issue

Therefore, the present disclosure is to resolve various issues including the issues aforementioned, and it is purposed to provide a soundproof housing of an earset and a wired and wireless earset comprising the same to block an echoing or howling effect by the inflow of external noise and reduce oscillation noise by a speaker and a microphone, thus enhancing the sound quality.

Also, another purpose of the present disclosure is to provide a soundproof housing of an earset and a wired and wireless earset comprising the same that enables a user to easily and quickly combine a speaker and a microphone within a soundproof housing, improves the assembly with a case and enhance its internal airtightness.

Moreover, another purpose of the present disclosure is to provide a soundproof housing of an earset and a wired and wireless earset comprising the same that blocks the inflow of external noise and have a waterproof function.

Furthermore, another purpose of the present disclosure is to provide a soundproof housing of an earset and a wired and wireless earset comprising the same that, in order to enlarge a speaker's appearance, separately forms a speaker housing portion with a speaker accommodation groove for accommodating a speaker and a microphone housing portion with a microphone accommodation groove for accommodating a microphone, thus improving the quality of voice and sound.

However, a purpose of the present disclosure is not construed to be limited only to the purposes described above, and with the descriptions below, another purpose not presented herein is clearly understood by one of ordinary skill in the art to which the present disclosure belongs.

Solution to Issue

In accordance with some embodiment, there is provided a soundproof housing for an earset, the housing comprising a housing main body coupled with the inside of a front surface case having a case body and a protrusion portion extended from the case body and inserted into the ear, and provided with a speaker accommodation groove for accommodating a speaker and a microphone accommodation groove for accommodating a microphone; a speaker output hole penetratingly formed in the speaker accommodation groove so as to communicate with the front surface case and adjacent to an output end of the speaker; and a microphone input hole penetratingly formed in the microphone accommodation groove so as to communicate with the front surface case and adjacent to an input end of the microphone, wherein the housing main body protrudes toward the inside of a protrusion portion of the front surface case so as to be tightly coupled with the inside of a protrusion portion of the front surface case.

In accordance with some embodiment, the inside of the case body and the inside of the protrusion portion communicate with each other, the outside of the protrusion portion has an opening, and the output hole of the speaker and the input hole of the speaker are directly exposed to the outside of the protrusion portion.

In accordance with some embodiments, the housing main body contains a first soundproof housing; and a second soundproof housing removably combined with the first soundproof housing and coupled with the inside of the front surface case.

In accordance with some embodiments, the first soundproof housing and the second soundproof housing, in order to block an inflow of noise, are obturated by at least one of the following: a rubber ring, an adhesive, or an interference fit.

In accordance with some embodiments, the housing further contains an output guiding portion formed to be indented and stepped on the second soundproof housing and adjacent to the speaker output hole so as to guide output signals from the output end of the speaker into the speaker output hole.

In accordance with some embodiments, the housing further contains an input guiding portion formed to be indented and stepped on the second soundproof housing and adjacent to the microphone input hole so as to guide input signals from the microphone input hole into the input end of the microphone.

In accordance with some embodiments, the housing further contains an input guiding portion that protrudes toward the outside of the second soundproof housing and adjacent to the microphone input hole so as to guide input signals from the microphone input hole into the input end of the microphone.

In accordance with some embodiments, the housing further contains at least one back hole that is penetratingly formed in the second soundproof housing and inputs signals into the rear of the input end of the microphone; and a back hole guiding portion formed to be indented and stepped on at least either the inside or the outside of the back hole.

In accordance with some embodiments, a cross section of the speaker accommodation groove and the microphone accommodation groove is at least one form of the following: a quadrangle, a rectangle, a circle, or an oval.

In accordance with some embodiments, the housing contains a display that shows a direction for combination with the front surface case.

In accordance with some embodiments, there is provided a soundproof housing for an earset, the housing comprising a housing main body coupled with the inside of a front surface case having a case body and a protrusion portion extended from the case body and inserted into the ear, and provided with a speaker accommodation groove for accommodating a speaker and a microphone accommodation groove for accommodating a microphone; a speaker output hole penetratingly formed in the speaker accommodation groove so as to communicate with the front surface case and adjacent to an output end of the speaker; and a microphone input hole penetratingly formed in the microphone accommodation groove so as to communicate with the front surface case and adjacent to an input end of the microphone; and a guiding portion formed to be indented and stepped on at least either the speaker accommodation groove or the microphone accommodation groove so as to guide signals moving through the speaker output hole or the microphone input hole.

Meanwhile, a wired and wireless earset of the present disclosure contains a soundproof housing for an earset with one of the features described above.

In accordance with some embodiments, there is provided a wired and wireless earset, the earset comprising a front surface case having a case body and a protrusion portion extended from the case body and inserted into the ear; a rear surface case removably combined with the front surface case; a first soundproof housing coupled with the inside of the rear surface case; and a second soundproof housing containing a speaker accommodation groove for accommodating a speaker and a microphone accommodation groove for accommodating a microphone that are removably combined with the first soundproof housing, and containing a speaker output hole adjacent to the output end of the speaker and a microphone input hole adjacent to the input end of the microphone, wherein the second soundproof housing is coupled with the inside of the protrusion portion of the front surface case so as to be tightly coupled with the inside of the protrusion portion of the front surface case, and the front surface case and the rear surface case, or the first soundproof housing and the second soundproof housing, are obturated with each other by means of at least one of the following: a rubber ring, an adhesive, or an interference fit.

In accordance with some embodiments, the protrusion portion of the front surface case further contains a penetration hole corresponding to the microphone input hole and the speaker output hole, and an input guiding portion formed to be indented and stepped on the protrusion portion so as to guide input signals from the ear.

In accordance with some embodiments, the earset further contains at least one back hole that is penetratingly formed in the second soundproof housing and inputs signals into the rear of the input end of the microphone; and a rear microphone hole penetratingly formed on the protrusion portion so as to correspond to at least one back hole above, wherein the input guiding portion is also formed on the protrusion portion adjacent to the rear microphone hole.

In accordance with some embodiments, there is provided a wired and wireless earset, the earset comprising a front surface case containing a case body, a speaker accommodation groove for accommodating a speaker formed at the inside of the protrusion portion, a microphone accommodation portion for accommodating a microphone, a speaker output hole adjacent to the output end of the speaker, and a microphone input hole adjacent to the input end of the microphone; and a rear surface case removably combined with the front surface case.

Effects of Invention

In accordance with some embodiments, an echoing or howling effect by the inflow of external noise is prevented, and oscillation noise by a speaker and a microphone is reduced, thus enhancing the sound quality.

Moreover, a user easily and quickly combine a speaker and a microphone within a soundproof housing, and the assembly of a soundproof housing and a case improves and its internal airtightness also improves.

Furthermore, a user separately forms a speaker housing portion with a speaker accommodation groove for accommodating a speaker and a microphone housing portion with a microphone accommodation groove for accommodating a microphone in order to enlarge a speaker's appearance, thus improving the quality of voice and sound.

DESCRIPTION FOR MARK

Figure 1:
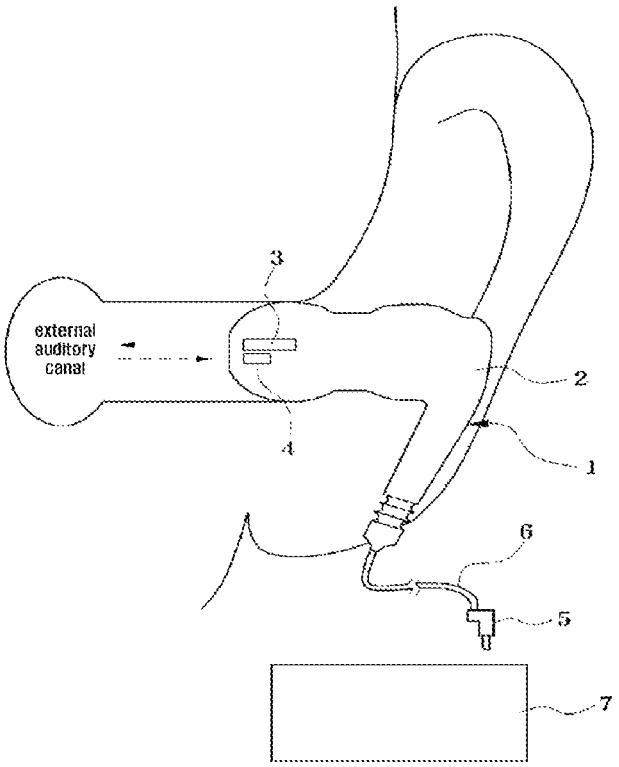
FIG. 1 is a schematic composition of an integrated earset in accordance with an existing embodiment.

10, 10*a*: earset 30: speaker
31: output end 40: microphone
41: input end 60: cable
100: rear surface case 200: front surface case
210: case body 220: protrusion portion
300: soundproof housing 301: first soundproof housing
302: second soundproof housing 310: housing main body
320: protrusion portion for insertion 330: speaker accommodation groove
331: speaker output hole 332, 333: back hole
330*a*, 330*b*: output guiding portion 340: microphone accommodation groove
341: microphone input hole 340*a*: input guiding portion
350: display 400: ear pad
410: pad body 411: projection

MODE FOR INVENTION

A soundproof housing for an earset and a wired and wireless earset comprising the same will be described more fully hereinafter with reference to the accompanying drawing, in which some embodiments are shown. It is noted that the same reference numbers indicate the same component throughout the specification. Advantages and features of some embodiments accomplishing the same are hereafter detailed with reference to the accompanying drawings. The soundproof housing for an earset and a wired and wireless earset comprising the same are embodied in different forms and should not be construed as limited to the embodiments set forth herein. Rather, these embodiments are provided so that this disclosure will be thorough and complete, and will fully convey the scope of the soundproof housing for an earset and a wired and wireless earset comprising the same to those skilled in the art. Unless defined otherwise, all technical and scientific terms used herein have the same meaning as commonly understood by one of ordinary skill in the art to which this application belongs. It is noted that the use of any and all examples, or exemplary terms provided herein is intended merely to better illuminate the electrical brain stimulation system and is not a limitation on the scope of the electrical brain stimulation system unless otherwise specified. Further, unless defined otherwise, all terms defined in generally used dictionaries may not be overly interpreted. The use of the terms "a" and "an" and "the" and similar referents in the context of describing the electrical brain stimulation system (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

An earset of the present disclosure is an apparatus configured be inserted into the ear wherein a speaker and a microphone is integrated and is applicable to an earphone for listening to music, a wired ear microphone, a Bluetooth headset, a wi-fi headset, an NFC (near-field communication) headset, or a binary CDMA (code division multiple access) headset.

Figure 2:
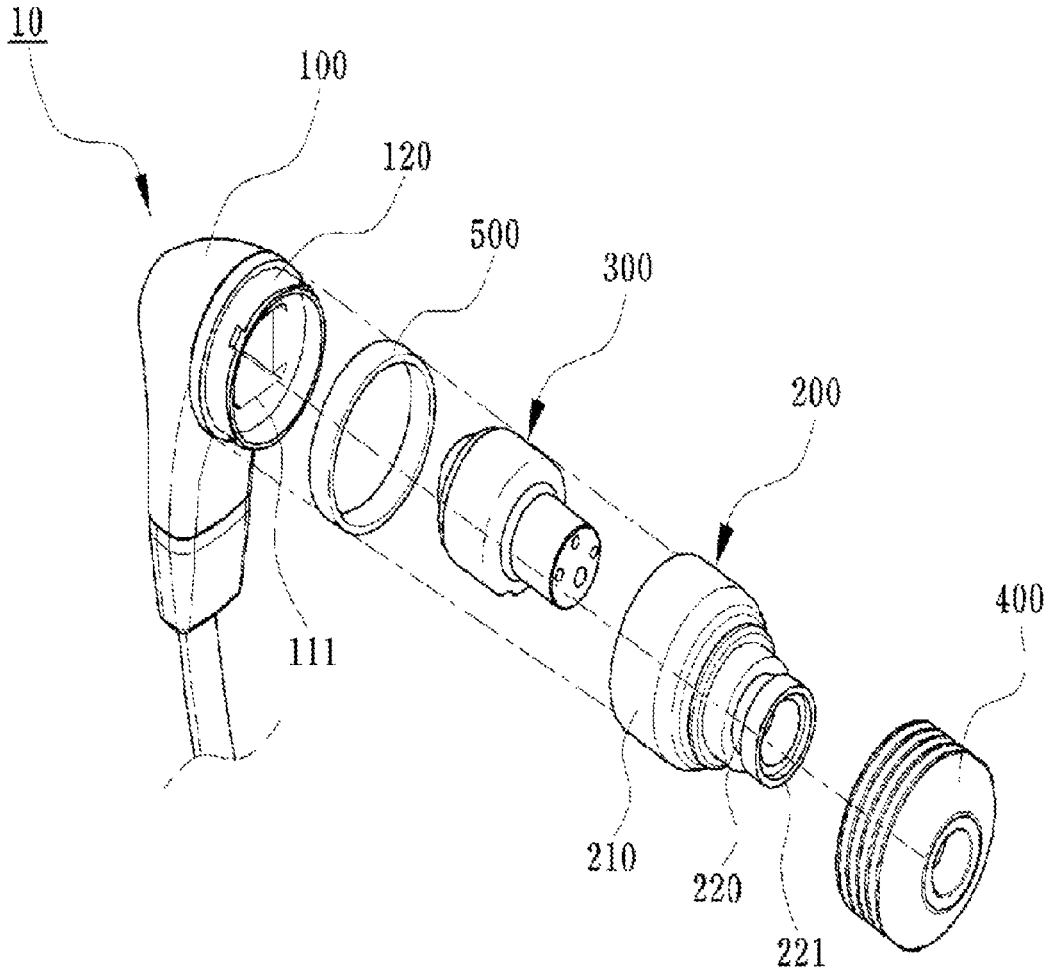
FIG. 2 is an exploded perspective view of the earset in some embodiments.

FIG. 2 is an exploded perspective view of the earset in some embodiments.

As shown in FIG. 2, an earset 10 is a wired earset that comprises a rear surface case 100, a front surface case 200, a soundproof housing 300, and an ear pad 400.

Figure 7:
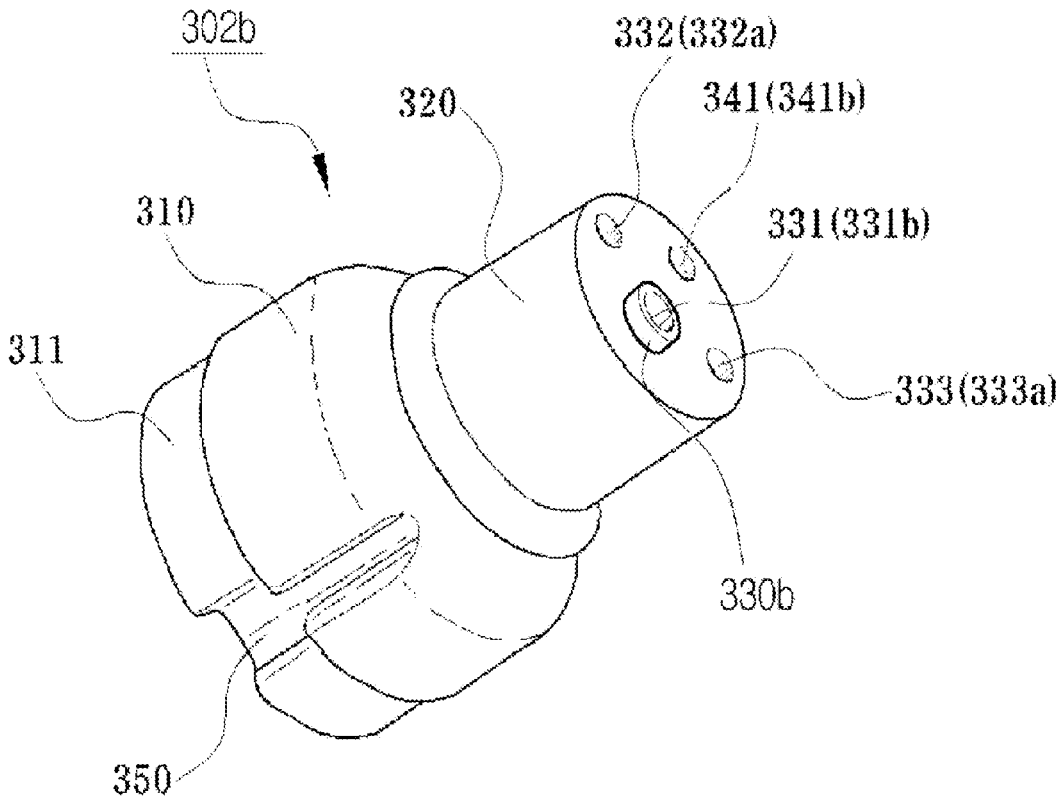
FIG. 7 is a perspective view of a second soundproof housing in another embodiment.

A rear case 100 forms an exterior of an earset 10 and is connected to a cable 60 in FIG. 7, and the cable 60 is combined with a connector (not presented) connectible with external device. Also, a wireless earset is directly connectible to a Bluetooth body in an electrical manner or a mechanical manner.

A front surface case 200 is a part inserted into the inside of an ear, which is coupled with a rear surface case 100 to form a case. A front surface case 200 contains a case body 210 removably combined with a rear surface case 100 and a protrusion portion 220 that protrudes toward the outside of a protrusion portion. The inside of the case body 210 and the inside of the protrusion portion 220 communicate with each other. In other words, the front surface case 210 and the protrusion portion 220 are integrated having a penetrating large hole.

A rear surface case 100 and a front surface case 200 are, in order to prevent external noise from flowing into the inside of a case, obturated by at least one of the following: a rubber ring, an adhesive, or an interference fit. For an example, as shown in FIG. 2, a ring installation groove 120 is formed on the border of the rear surface case 100 where the inner side of a rubber ring is inserted and installed, and a ring sticking groove (not presented) is formed on the inner border of the engaging surface of the front surface case 200.

A soundproof housing 300 is a form of combination of a first soundproof housing 301 and a second soundproof housing 302 and is coupled within a space of a rear surface case 100 and a front surface case 200, while in its inside components such as a microphone 40 and a speaker 30 that transceive sound.

A soundproof housing blocks an echoing and a howling that occur by an inflow of external noise through a front surface case 200 and a rear surface case 100 and reduces oscillation noise by a speaker 30 and a microphone 40, thus improving a quality of sound. Detailed description of it will follow.

An ear pad 400 is installed at a front surface case 200, that is, a protrusion portion 220 so as to the front surface case 200 is easily inserted into an ear. The ear pad 400 is made of elastic materials such as silicon or rubber.

An ear pad 400 contains a pad body 410 installed at a front surface case 200 and a plurality of sound insulation projections 411 that prevent noise from flowing into an ear from an externality and also prevent sound delivered into the inside of the ear from escaping to an externality.

Also, sound insulation projections 411 increase friction within an ear so as to let an earset 10 adhered to an external auditory canal and make the earset 10 not easily removed from the ear, thus enabling its user to make a call or listen to a song even during an exercise.

Figure 3:
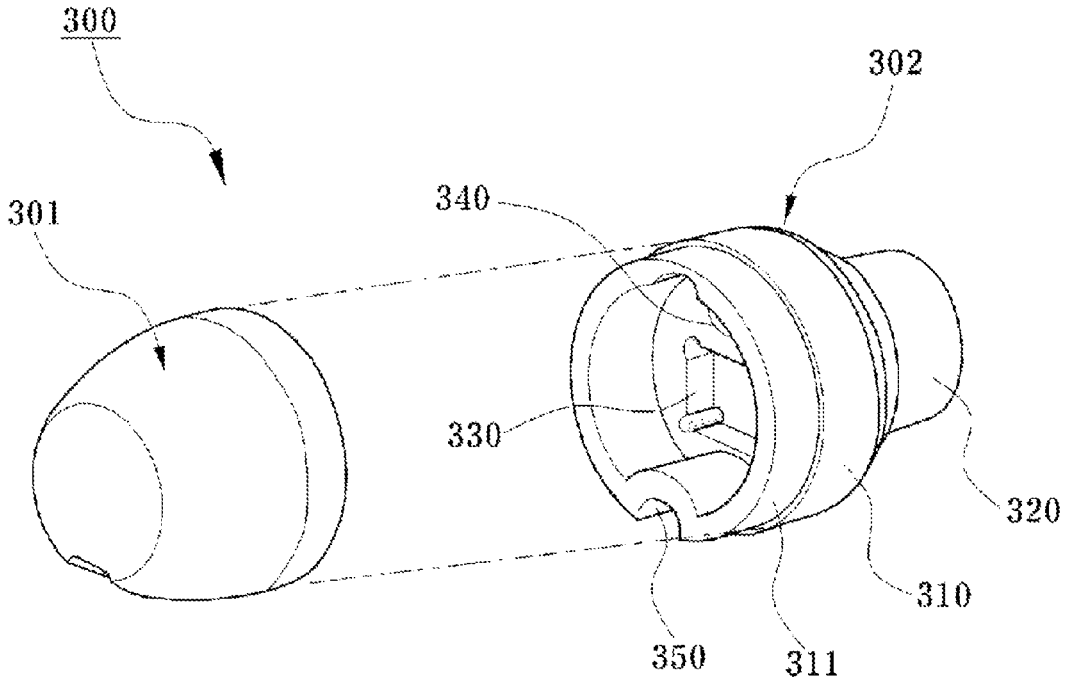
FIG. 3 is an exploded perspective view that magnifies a soundproof housing in FIG. 2.
Figure 4:
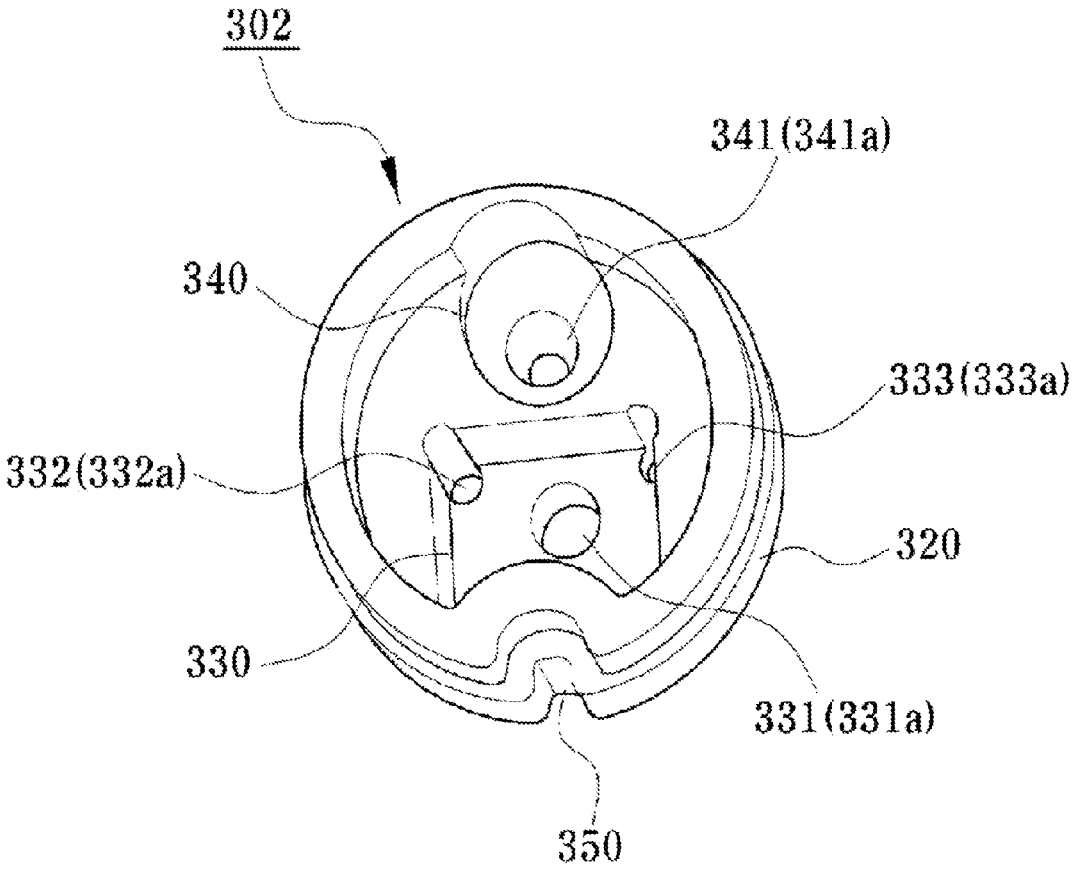
FIG. 4 is a perspective view for a bottom of a soundproof housing in FIG. 3.
Figure 5:
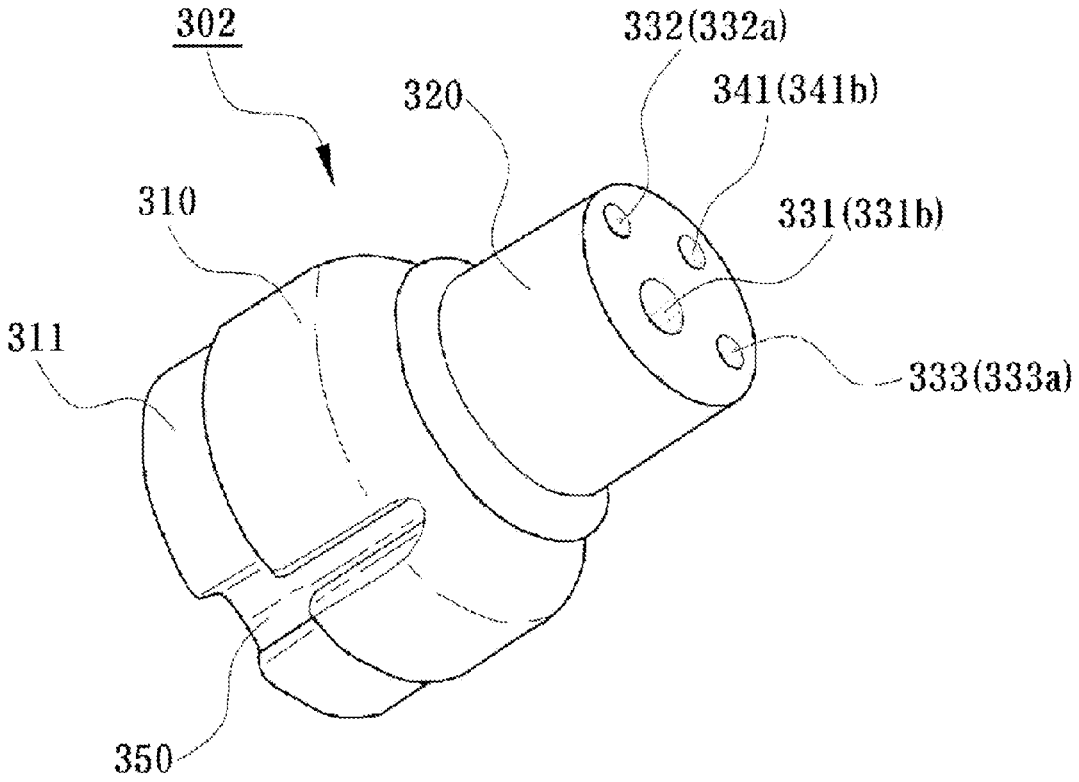
FIG. 5 is a perspective view of a soundproof housing in FIG. 3 seen in another direction.

FIG. 3 is an exploded perspective view that magnifies a soundproof housing in FIG. 2. FIG. 4 is a perspective view for a bottom of a soundproof housing in FIG. 3, and FIG. 5 is a perspective view of a soundproof housing in FIG. 3 seen in another direction.

As shown in FIG. 3, a soundproof housing 300 comprises a first soundproof housing and a second soundproof housing removably combined with the first soundproof housing and coupled with the inside of the front surface case.

For an availability of assembly and a blocking of external noise and an effectual delivering of sound signals received from the inside into a user's external auditory canal, a soundproof housing 300 is made of sound absorbing materials, plastics, rubber or silicon.

Also, a first soundproof housing 301 and a second soundproof housing 302, in order to block an inflow of noise, are obturated by at least one of the following: a rubber ring, an adhesive, or an interference fit. For an example, as shown in FIG. 3, a rubber ring installation groove 311 on which a rubber ring (not presented, see 500 in FIG. 2) is installed is formed on the inner border of the engaging surface of a first soundproof housing 301 and a second soundproof housing 302.

A speaker 30 (see FIG. 8) and a microphone 40 (see FIG. 8) are accommodated and installed in an inner space between a first soundproof housing 301 and a second soundproof housing 302, and for accommodating and installing them, a housing main body 310, a speaker accommodation groove 330 for accommodating a speaker 30 and a microphone accommodation groove 340 for accommodating a microphone 40 are formed at the second soundproof housing 302.

The speaker 30 has various types, for example, a closed and balanced armature type speaker 30 that has ampler sound support than a dynamic speaker 30, or a piezoelectric type speaker 30. The microphone 40 has also various types, for example, a directional microphone 40 that has a hall on the rear surface of an input end of the microphone.

As shown in FIG. 4, a speaker accommodation groove 330 has a form dented with a constant depth on the center of a housing main body 310. An output end 31 of a speaker 30 is adjacent to the speaker accommodation groove 330, and the speaker accommodation groove 330 has a speaker output hole 331 communicating with a front surface case 200.

A microphone accommodation groove 340 has a form dented with a constant depth at a distance from the speaker accommodation groove 330 so as to accommodate a microphone 40. An input end 41 of a microphone 40 is adjacent to the microphone accommodation groove 340, and the microphone accommodation groove 340 has a microphone input hole communicating with a front surface case 200.

It is noted that the speaker accommodation groove 330, the speaker output hole 331, the microphone accommodation groove 340 and the microphone input hole 341 presented in the drawings are just exemplary to the present disclosure, and that their form, direction, location, number and size are modifiable in some embodiments. For an instance, a blockade (not presented) is located between ac.

A soundproof housing 300 with the composition aforementioned is installed within a front surface case 200 so that sound is clearly transceived through a speaker output hole 331 and a microphone input hole 341.

For an example, the outer edge 221 of a protrusion portion 220 of a front surface case 200 has penetration holes (not presented) corresponding to a speaker output hole 331 and a microphone input hole 341, and the rest is obturated so that external noise is blocked. In this case, a speaker output hole 331 and a microphone input hole 341 of a soundproof housing 300 are hard to correspond to the penetration holes (not presented) formed on the protrusion portion 220 of the front surface case 200 and the matching could be not correctly done.

Thus, in order that the soundproof housing 300 is tightly combined within the protrusion portion 220 of the front surface case 200, a housing main body 310 protrudes long toward the inside of the protrusion portion 220 of the front surface case 200. For an instance, as shown in FIG. 5, a protrusion portion for insertion 320 corresponding to the inner form of the protrusion portion 220 of a front surface case 200 is formed on the second soundproof housing 302.

Ends of the speaker output hole 331 and the microphone input hole 341 are extended at the end of the protrusion portion for insertion 320. Therefore, if a second soundproof housing 302 is installed at a front surface case 200, the protrusion portion for insertion 320 of the second soundproof housing 302 approaches within the neighborhood to the penetration holes (not presented) formed on the outer edge 221 of a protrusion portion 220 of a front surface case 200 and corresponds the speaker output hole 331 and a microphone input hole 341 within a short period.

Meanwhile, the input guiding portion abovementioned, not presented in detail, are arranged on a front surface case 200 as well as a soundproof housing 300.

For an example, an input guiding portion is formed to be indented and stepped on the protrusion portion 220 of the front surface case 200 and guides input signals from the ear so as to be adjacent to the penetration holes (not presented) corresponding to the microphone input hole 341. Herein, since the penetration holes (not presented) formed on the protrusion portion 220 contain a rear microphone hole (not presented) corresponding to back holes 322 and 323 described later, the input guiding portion can be formed on a protrusion portion adjacent to the rear microphone hole.

Furthermore, when a soundproof housing 300 is composed with the protrusion portion for insertion 320 abovementioned, since the one-to-one correspondence between each hole of the front surface case 200 and the second soundproof housing 302, it is possible to make the outer edge 221 of a protrusion portion 220 of a front surface case 200 in an open form with no penetration hole.

In other words, a speaker output hole 331 and a microphone input hole 341 located in the end of the protrusion portion for insertion 320 of the soundproof housing 300 inserted into protrusion portion 220 of the front surface case 200 is directly exposed to the outer edge 221 of a protrusion portion 220 of a front surface case 200, thus playing a role in an outer surface of the protrusion portion 220 of the front surface case 200 aforementioned. Therefore, a user more easily assemble the front surface case 200 and the second soundproof housing 302.

Meanwhile, a display 350 is formed that informs a direction for combination with the front surface case in addition to the abovementioned form. For an instance, the display 350, as shown in FIG. 5, has an indented form on the side of a soundproof housing 300, or it uses indications such as a protruded projection or signs, letters, etc. Also, a display is formed on the soundproof housing 300 of the front surface case 200.

Thus, checking a combination of a soundproof housing 300 and a front surface case 200 visually, a user more easily combine the two.

Figure 6:
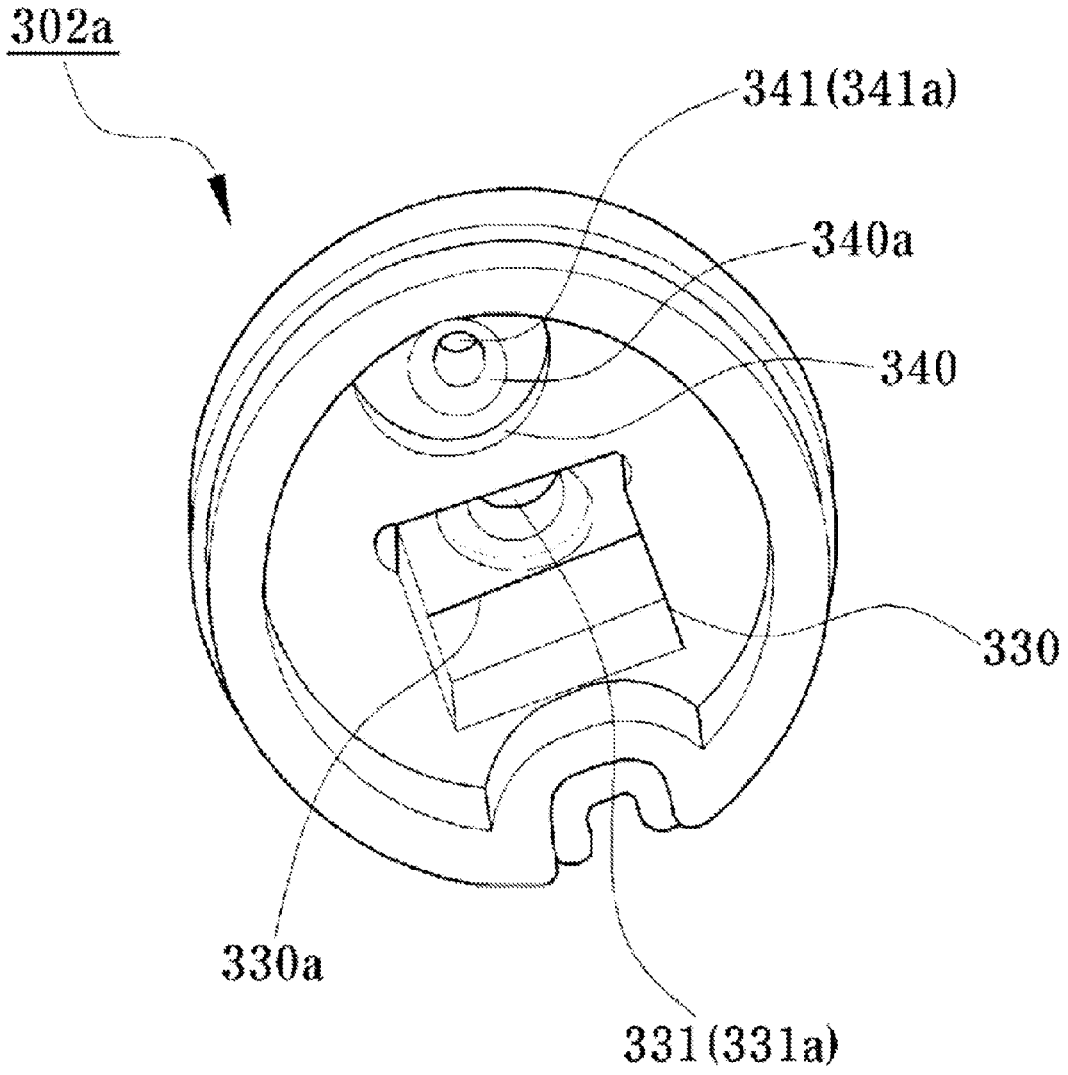
FIG. 6 is a perspective view for a bottom of a soundproof housing in FIG. 3 in another embodiment.
Figure 8:
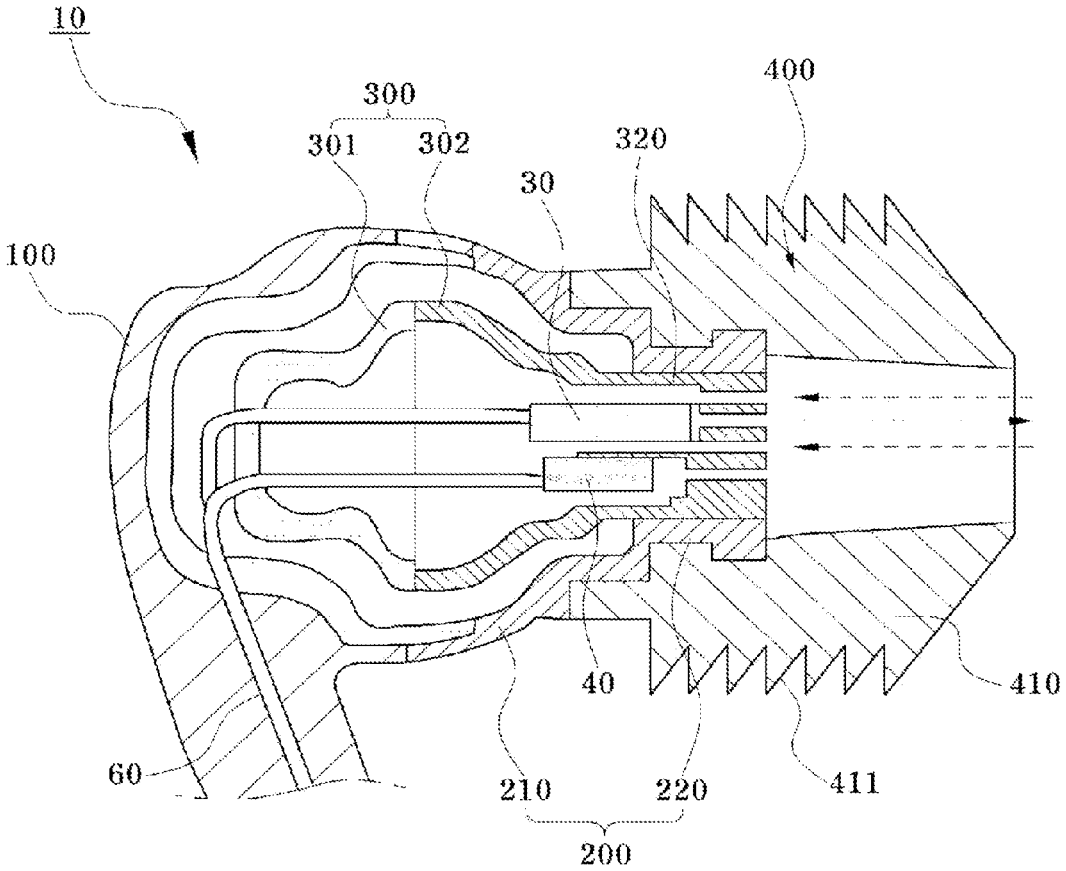
FIG. 8 is a cross section where the earset in FIG. 2 is combined.
Figure 9:
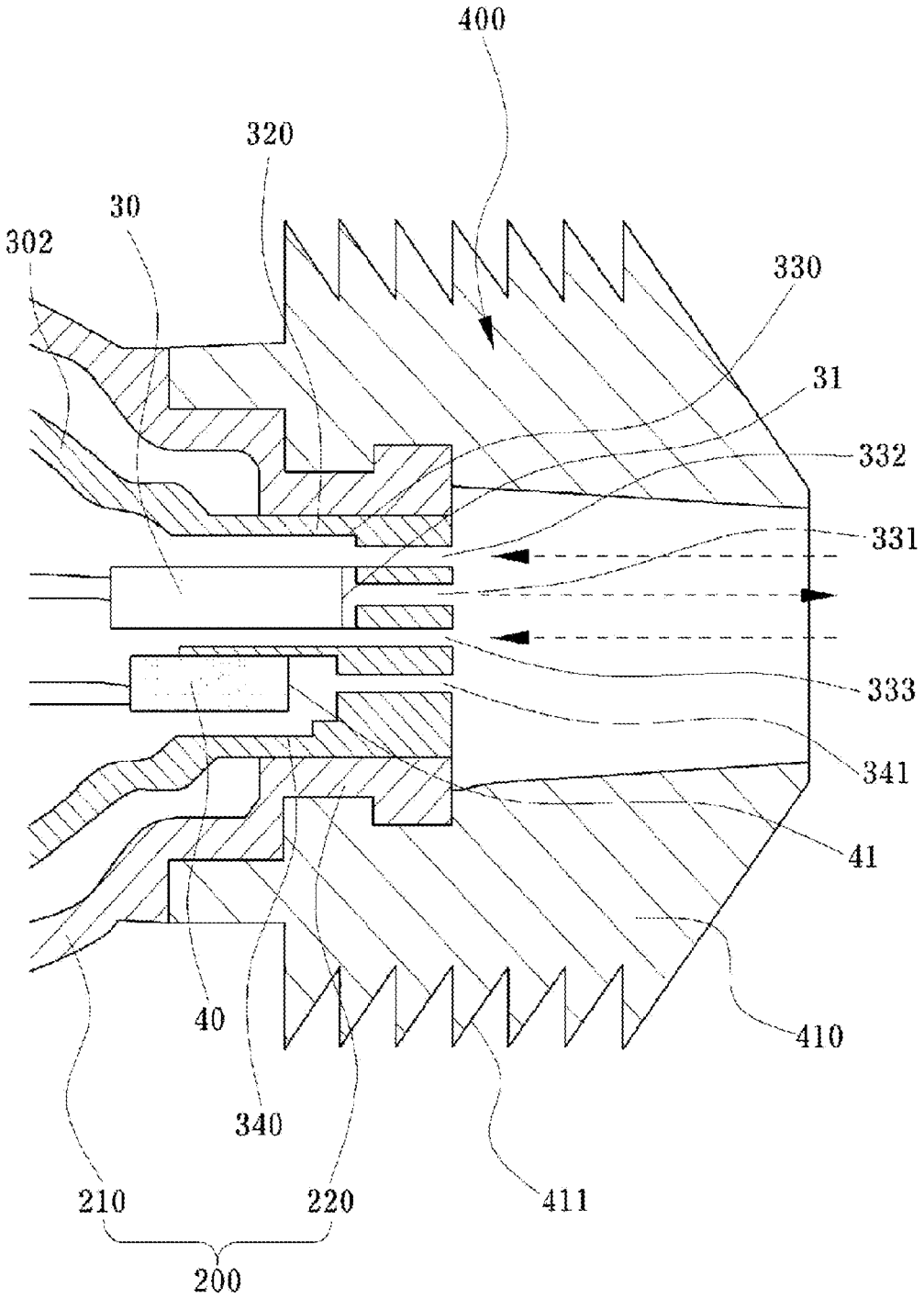
FIG. 9 is a magnified drawing for the principal part of FIG. 8.

FIG. 6 is a perspective view for a bottom of a soundproof housing in FIG. 3 in another embodiment, FIG. 7 is a perspective view of a second soundproof housing in another embodiment, FIG. 8 is a cross section where the earset in FIG. 2 is combined, and FIG. 9 is a magnified drawing for the principal part of FIG. 8.

Meanwhile, if a speaker 30 is installed in a speaker accommodation groove 330 formed within the inside of a soundproof housing 300 and a microphone 40 is installed in a microphone accommodation groove 340, each of a speaker output hole 331 and a microphone input hole 341 should have an output end 31 of a speaker 30 and an input end 41 of a microphone 40, respectively, in a right position.

For the purpose above, in another embodiment, an output guiding portion 330*a* formed to be indented and stepped on a speaker accommodation groove 330 compared to the speaker output hole 331 so as to guide output signals from the output end of the speaker 31 into the speaker output hole 331 is formed in a second soundproof housing 302*a*.

For an example, an output guiding portion 330*a* is located in the inside 331*a* of the speaker output hole 331 and is formed as a groove in a border form indented with a constant depth so as to embrace of the outside of the speaker output hole 331.

And, as shown in FIG. 7, an output guiding portion 330*b* embraces the speaker output hole 331 of the output guiding portion 330*b*, and is formed protuberantly to its outside.

Therefore, an output guiding portion 330*b* prevent noise caused by speaker output since it is tightly adjacent to the inside (not presented) of a front surface case 200 and makes easy speaker output.

Furthermore, the output guiding portion 330*b* tightly adheres to the inside of the front surface case 200, thus waterproofing is easily performed.

Moreover, an input guiding portion 340*a* is formed to be indented and stepped compared to a microphone input hole 341 at a microphone accommodation groove 341 so as to guide input signals from an input end of a microphone 41. Likewise, an input guiding portion 340*a* is located in the inside 341*a* or outside 341*b* of the microphone input hole 341 as the same form of an output guiding portion 330*a*, and it is formed as a border groove dented with a constant depth so as to embrace the outside of the microphone input hole 341.

Of course, it is also noted that a form, size, depth, etc. of the output guiding portion 330*a* and the input guiding portion 340*a* aforementioned is embodied in a various way.

Meanwhile, second soundproof housings 302, 302*a* and 302*b* of abovementioned embodiments have at least a back hole 332 and 333 making signals inputted into a rear surface of an input end of a microphone 41 and back hole guiding portions (not presented) formed to be indented and stepped on the inside 332*a* and 333*a* or the outside 332*b* and 333*b*.

It is also noted that back hole guiding portions is embodied like the output guiding portion 330*a* and the input guiding portion 340*a*, and its form, size or depth is embodied in a various way.

Likewise, since a soundproof housing 300 contains an output guiding portion 330*a*, an input guiding portion 340*a* and back hole guiding portions thus forming a guiding portion, if a speaker 30 and a microphone 40 is equipped within the soundproof housing 300, sound is clearly transceived by the guiding portion, even the holes does not fit to each other.

Figure 10:
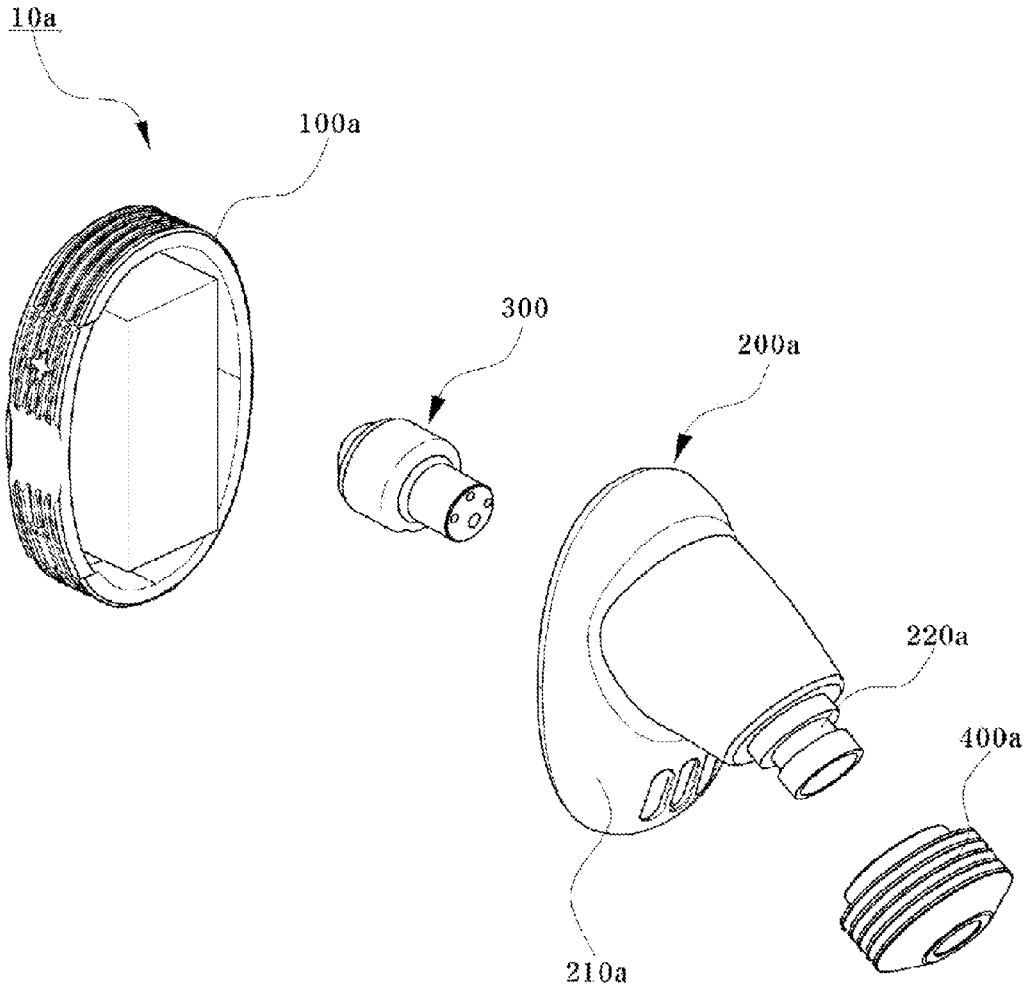
FIG. 10 is an exploded perspective view of the earset in another embodiment.

FIG. 10 is an exploded perspective view of the earset in another embodiment.

As shown in FIG. 10, an earset 10*a*, unlike the wired earset 10 abovementioned, is a wireless earset in a formed of Bluetooth, etc. The earset 10*a* also comprises a rear surface case 100*a*, a front surface case 200*a*, a soundproof housing 300 and an ear pad 400*a*. The detailed description for the earset is the same as the description above.

Meanwhile, the earset aforementioned in some embodiments includes a soundproof housing 300, a speaker accommodation groove 330, a microphone accommodation groove 340, a microphone input hole 341, a speaker output hole 331 and a back hole 332 and 333. That is, a soundproof housing 300 comprises a first soundproof housing 301 and a second soundproof housing 302, and the second soundproof housing 302 comprises the speaker accommodation groove 330, the microphone accommodation groove 340, the microphone input hole 341, the speaker output hole 331 and the back hole 332 and 333.

However, it is noted that in another form of the present disclosure, in order to reduce the number of components and thus reduce the cost, a composition of a second soundproof housing 302 is directly realized within the inside of a front surface case 200.

For an instance, though not presented in detail, like the second soundproof housing 302 aforementioned, a speaker accommodation groove (not presented) for accommodating a speaker 30, a microphone accommodation groove (not presented) for accommodating a microphone, a speaker output hole (not presented) adjacent to an output end 31 of a speaker 30, a microphone input hole 341 adjacent to an input end 41 of a microphone 40, at least a back hole (not presented) to make signals inputted into a rear surface of the input end 41 of a microphone.

Herein, on a protrusion portion 220 of a front surface case 200, components equipped at the abovementioned second soundproof housing 302 are formed. That is, an output guiding portion (not presented) that guides output signals from an output end of the speaker 31 into a speaker output hole 331, an input guiding portion (not presented) that guides input signals from a microphone input hole 341 into an input end 41 and a back hold guiding portion (not presented) that guides signals into a rear surface of a microphone through a back hole are formed on a protrusion portion of a front surface case 200, components equipped at the abovementioned second soundproof housing 302.

Herein, an input guiding portion, an output guiding portion and a back hold guiding portion, like the above embodiments, have a indented and stepped form on a protrusion portion 220 of a front surface case 200.

Figure 11:
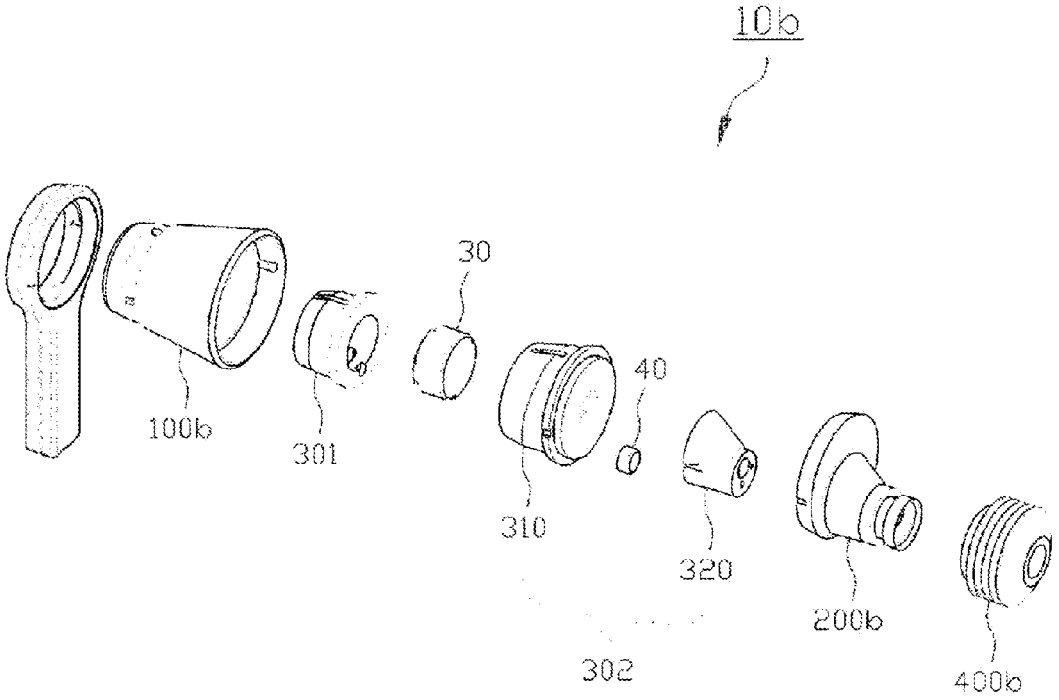
FIG. 11 is an exploded perspective view of the earset in yet another embodiment.
Figure 12:
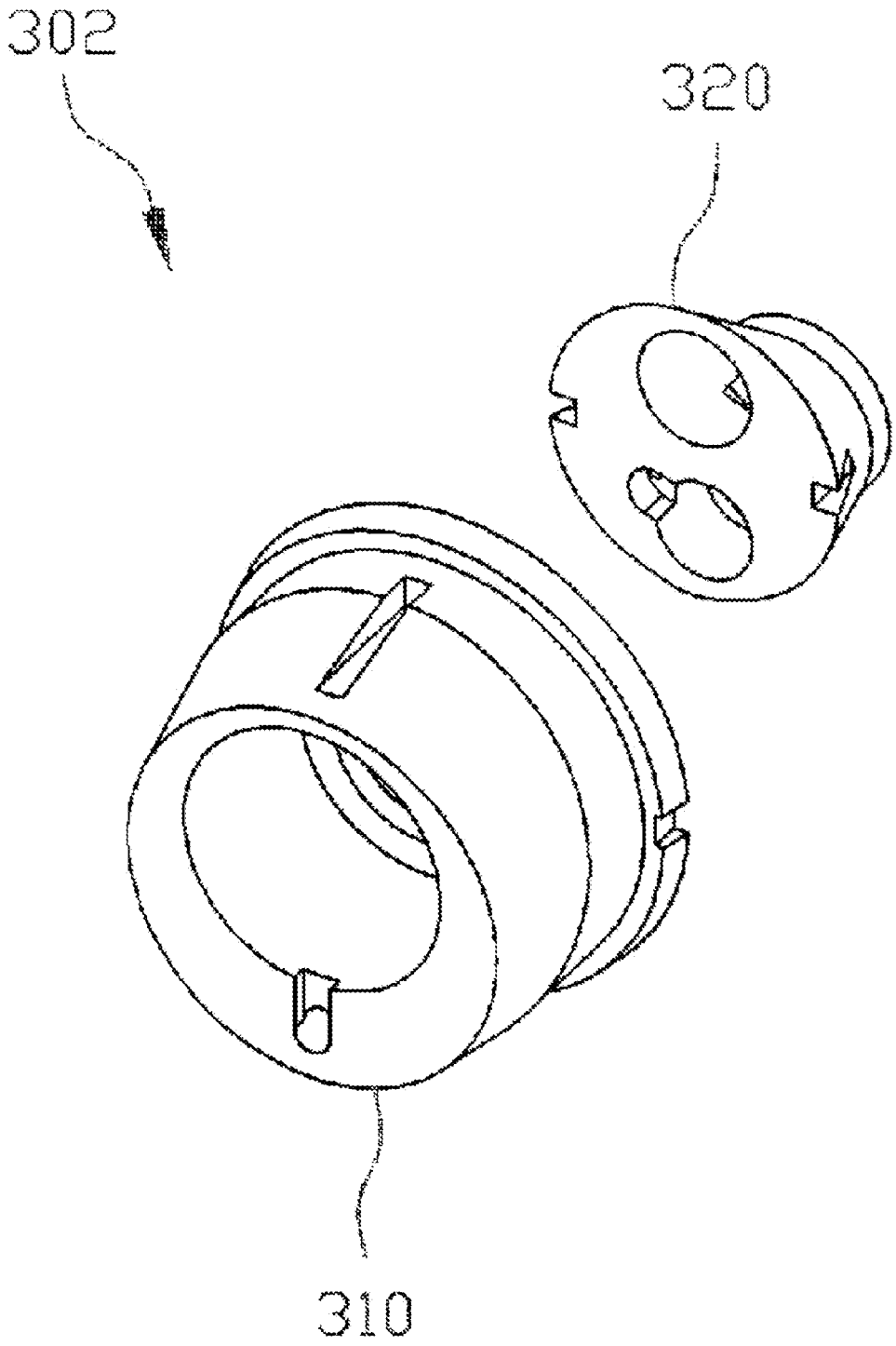
FIG. 12 is a perspective view for a formation of a housing main body and a rear surface of a protrusion portion of insertion in FIG. 11.

FIG. 11 is an exploded perspective view of the earset in yet another embodiment, and FIG. 12 is a perspective view for a formation of a housing main body and a rear surface of a protrusion portion of insertion in FIG. 11.

In accordance with FIG. 11 and FIG. 12, an earset 10*b* also comprises a rear surface case 100*b*, a front surface case 200*b*, a soundproof housing 300*b* and an ear pad 400*b*, and the detailed description for this composition is the same as one mentioned before.

As shown in FIG. 3, the soundproof housing 300 comprises a first soundproof housing 301 and a second housing 302, and is coupled within a space formed between a rear surface face 100*b* and a front surface case 200*b*.

The second housing 302 is separately formed into a housing main body 310 and a protrusion portion for insertion 320 so as to avoid issues that, when forming a speaker accommodation groove for accommodating a speaker 30 and a microphone accommodation groove for accommodating a microphone 40 in order to accommodate a speaker and a microphone within one soundproof housing in an integrated speaker and microphone system, output sound is too low and the quality of voice and sound is worsen.

In other words, in some embodiments, a speaker accommodation groove and a microphone accommodation groove are separately formed within each soundproof housing, wherein the speaker accommodation groove is formed as a dented shape with a constant depth on a rear surface of the housing main body 310 so as to accommodate a speaker 30, and the microphone accommodation groove is formed as a dented shape with a constant depth on a rear surface of the protrusion portion for insertion 320 so as to accommodate a microphone 40.

The housing main body 310 and the protrusion portion for insertion 320 are made of silicon, rubber or synthetic resins, and they make components equipped within a speaker 30 and a microphone 40 installed easily, block external noise and prevent sound from escaping to an externality.

A speaker accommodation groove for accommodating a speaker 30 is formed on the housing main body 310, and on a front surface it has a big hole from the speaker accommodation groove so as to deliver sound generated from the speaker to the inside of an ear and a small hole through which a microphone power cable or a microphone output cable passes. The hole's shape, size, number and location are available to variation.

A microphone accommodation groove for accommodating a microphone 40 is formed on the protrusion portion for insertion 320, and it has a big hole communicating with the big hole of the housing main body 310 so as to deliver sound generated from the speaker to the inside of an ear and two small holes so as to deliver sound generated from the inside of an ear to the microphone 40. It is apparent that its shape, size, number and location are also available to variation.

Each side of the surface of the housing main body 310 and the protrusion portion for insertion 320 has a groove for assembly with the case.

Like so, in accordance with soundproof housing for an earset and a wired and wireless earset comprising the same, an echoing or howling effect by the inflow of external noise is prevented, and oscillation noise by a speaker and a microphone is reduced, thus enhancing the sound quality.

Moreover, a user easily and quickly combine a speaker and a microphone within a soundproof housing, and the assembly of a soundproof housing and a case improves and its internal airtightness also improves.

In concluding the detailed description, it is noted that the description above is presented as illustration for the present disclosure in some embodiments, and those skilled in the art will appreciate that many variations and modifications can be made to the preferred embodiments without substantially departing from the principles of the some embodiments described above. Therefore, the described some embodiments are used in a generic and descriptive sense only and not for purposes of limitation.

The invention claimed is:

1. A soundproof housing for an earset, the soundproof housing comprising:

a housing main body removably combined with the inside of a case body and the inside of a front surface case having a protrusion portion extended from the case body; and provided with a speaker accommodation groove for accommodating a speaker and a microphone accommodation groove for accommodating a microphone;

a speaker output hole penetratingly disposed in the speaker accommodation groove so as to communicate with the front surface case and adjacent to an output end of the speaker; and a microphone input hole penetratingly disposed in the microphone accommodation groove so as to communicate with the front surface case and adjacent to an input end of the microphone, wherein the housing main body protrudes toward the inside of the protrusion portion of the front surface case so as to be tightly combined with the inside of the protrusion portion of the front surface case, and wherein the housing main body comprises a groove having a lengthwise shape of semi-circle passage intruded toward the center of the housing main body, the lengthwise shape is lengthwise toward the front surface case.

2. The soundproof housing of the claim 1, wherein the inside of the case body and an inside of the protrusion portion communicate with each other, the outside of the protrusion portion has an opening, and the output hole of the speaker and the input hole of the microphone are directly exposed to an outside of the protrusion portion.

3. The soundproof housing of claim 1, wherein the housing main body contains a first soundproof housing; and a second soundproof housing removably combined with the first soundproof housing and coupled with the inside of the front surface case.

4. The soundproof housing of claim 3, wherein the first soundproof housing and the second soundproof housing, in order to block an inflow of noise, are obturated by at least one of the following: a rubber ring, an adhesive, or an interference fit.

5. The soundproof housing of claim 3, wherein the housing main body further contains an output guiding portion disposed to be indented and stepped on the second soundproof housing and adjacent to the speaker output hole so as to guide output signals from the output end of the speaker into the speaker output hole.

6. The soundproof housing of claim 3, wherein the housing main body further contains an input guiding portion disposed to be indented and stepped on the second soundproof housing and adjacent to the microphone input hole so as to guide input signals from the microphone input hole into the input end of the microphone.

7. The soundproof housing of claim 3, wherein the housing main body further contains an input guiding portion that protrudes toward the outside of the second soundproof housing and adjacent to the microphone input hole so as to guide input signals from the microphone input hole into the input end of the microphone.

8. The soundproof housing of claim 3, wherein the housing main body further contains at least one back hole that is penetratingly disposed in the second soundproof housing and inputs signals into the rear of the input end of the microphone;

and a back hole guiding portion disposed to be indented and stepped on at least either the inside or the outside of the back hole.

9. The soundproof housing of claim 1, wherein a cross section of the speaker accommodation groove and the microphone accommodation groove is at least one form of the following: a quadrangle, a rectangle, a circle, or an oval.

10. A wired and wireless earset, wherein the wired and wireless earset comprises the soundproof housing of claim 1.

11. A soundproof housing for an earset, the soundproof housing comprising:

a first soundproof housing removably combined with the inside of a rear surface case, and comprising a speaker accommodation groove for accommodating a speaker; and a second soundproof housing that is removably combined with the inside of a front surface case having a protrusion portion extended to an opposite direction to the rear surface case, protrudes toward the inside of the protrusion portion of the front surface case so as to be tightly combined with the inside of the protrusion portion of the front surface case, and comprises a microphone accommodation groove for accommodating a microphone, wherein the first soundproof housing comprises a speaker output hole penetratingly disposed in the speaker accommodation groove so as to communicate with the front surface case through a penetration hole of the second soundproof housing and adjacent to an output end of the speaker; and wherein the second soundproof housing comprises a microphone input hole penetratingly disposed in the microphone accommodation groove so as to communicate with the front surface case and adjacent to an input end of the microphone, and the penetration hole corresponding to the speaker output hole.

12. The housing of claim 11, wherein the second soundproof housing comprises a groove having a lengthwise shape of semi-circle passage intruded toward the center of the second soundproof housing, the lengthwise shape is lengthwise toward the front surface case.

13. A wired and wireless earset, the wired and wireless earset comprising:

a front surface case having a case body and a protrusion portion extended from the case body;

a rear surface case removably combined with the front surface case;

a first soundproof housing removably combined with the inside of the rear surface case and, comprising a speaker accommodation groove for accommodating a speaker; and a second soundproof housing configured to be removably combined with the inside of the front surface case having a protrusion portion extended to an opposite direction to the rear surface case, protrude toward the inside of the protrusion portion of the front surface case so as to be tightly combined with the inside of the protrusion portion of the front surface case, and comprising a microphone accommodation groove for accommodating a microphone, wherein the first soundproof housing comprises a speaker output hole penetratingly disposed in the speaker accommodation groove so as to communicate with the front surface case through a penetration hole of the second soundproof housing and adjacent to an output end of the speaker, wherein the second soundproof housing comprises a microphone input hole penetratingly disposed in the microphone accommodation groove so as to communicate with the front surface case and adjacent to an input end of the microphone, and the penetration hole corresponding to the speaker output hole, and wherein the front surface case and the rear surface case, or the first soundproof housing and the second soundproof housing, are obturated with each other by means of at least one of the following: a rubber ring, an adhesive, or an interference fit.

14. The wired and wireless earset of claim 13, wherein the protrusion portion of the front surface case further contains a penetration hole corresponding to the microphone input hole and the speaker output hole, and an input guiding portion disposed to be indented and stepped on the protrusion portion so as to guide input signals from the ear.

15. The wired and wireless earset of claim 14, wherein the earset further contains at least one back hole that is penetratingly disposed in the second soundproof housing and inputs signals into the rear of the input end of the microphone;

and a rear microphone hole penetratingly disposed on the protrusion portion so as to correspond to at least one back hole above, wherein the input guiding portion is also disposed on the protrusion portion adjacent to the rear microphone hole.

* * * * *